US005996669A

United States Patent [19]

Miller

[11] Patent Number: 5,996,669

[45] Date of Patent: Dec. 7, 1999

[54] SIDE TRACKS ADAPTED FOR USE WITH ROLLING PROTECTIVE SHUTTERS

[76] Inventor: James V. Miller, 893 N. Maryknoll Cir., Glen Ellyn, Ill. 60137

[21] Appl. No.: 08/997,079

[22] Filed: Dec. 23, 1997

Related U.S. Application Data

[63] Continuation-in-part of application No. 08/804,100, Feb. 20, 1997.

[51] Int. Cl.[6] ..... E06B 9/08

[52] U.S. Cl. ..... 160/133; 160/23.1; 160/183

[58] Field of Search ..... 160/23.1, 31, 273.1, 160/133, 183

[56] References Cited

U.S. PATENT DOCUMENTS

| | | | |
|---|---|---|---|
| 845,526 | 2/1907 | Collins . | |
| 1,892,570 | 12/1932 | Ginder | 160/273.1 X |
| 4,037,639 | 7/1977 | Jones | 160/133 |
| 4,294,302 | 10/1981 | Ricke, Sr. | 160/133 |
| 4,345,635 | 8/1982 | Solomon | 160/133 |
| 4,386,645 | 6/1983 | Dever et al. | 160/183 |
| 4,493,356 | 1/1985 | Hermann et al. | 160/133 |
| 4,611,848 | 9/1986 | Romano | 160/133 X |
| 4,726,409 | 2/1988 | Besler | 160/23.1 |
| 4,807,687 | 2/1989 | Finch et al. | 160/133 |
| 4,921,033 | 5/1990 | Finch et al. | 160/23.1 X |
| 4,929,862 | 5/1990 | Hamilton et al. | 312/138.1 |
| 4,944,341 | 7/1990 | Trippner et al. | 160/31 X |
| 5,070,925 | 12/1991 | Paule | 160/133 |
| 5,343,924 | 9/1994 | Hoffman | 160/235 |
| 5,365,990 | 11/1994 | Ueda | 160/23.1 |
| 5,469,905 | 11/1995 | McKinney et al. | 160/35 |
| 5,469,908 | 11/1995 | McKinney et al. | 160/183 X |
| 5,566,738 | 10/1996 | Yadidya | 160/133 |
| 5,575,322 | 11/1996 | Miller | 160/133 |
| 5,586,592 | 12/1996 | McGregor | 160/133 |
| 5,601,130 | 2/1997 | Werner et al. | 160/183 |
| 5,655,587 | 8/1997 | Kraler | 160/31 |
| 5,682,937 | 11/1997 | Decrane et al. . | |
| 5,850,862 | 12/1998 | Miller | 160/133 |

FOREIGN PATENT DOCUMENTS

| | | |
|---|---|---|
| 2 697 280 | 4/1994 | France . |
| 27 05 119 | 8/1978 | Germany . |

OTHER PUBLICATIONS

English–language abstract of German–language publication 27 05 119 (Item B1).

English–language abstract of French–language publication 2 697 280 (Item B2).

Sweet's General Building & Renovation 1997 Catalog File, atlas™, 1997 Product Guide, 08330/ATL, BuyLine 0371, pp. 1–23.

(List continued on next page.)

*Primary Examiner*—Blair M. Johnson
*Attorney, Agent, or Firm*—Marshall, O'Toole, Gerstein, Murray & Borun

[57] ABSTRACT

A rolling shutter assembly having a shutter support member and a shutter coupled to the shutter support member. The shutter has a plurality of individual slats and a plurality of hinges interconnecting the slats. Each of the slats has a pair of end portions, and the slats include a first set of slats and a second set of slats, each of the slats in the first and second sets being alternated so that each of the hinges is connected to one of the slats in the first set and one of the slats in the second set. The shutter further includes a plurality of extension members extending from the slats and/or the hinges. The shutter assembly has a pair of shutter tracks and means for rolling the shutter from an extended position in which the end portions of the slats are disposed in the shutter tracks to a retracted position in which the shutter is rolled up on the shutter support member. The shutter tracks further include guide channels and guide means which cause the extension members to be disposed within the guide channels to cause the slats in the first set of slats to occupy a first relative position and the slats in the second set of slats to occupy a second relative position while the shutter is being unrolled.

3 Claims, 8 Drawing Sheets

OTHER PUBLICATIONS

Sweet's General Building & Renovation 1997 Catalog File, Cornell Iron Works, "Rolling Doors and Grilles," 08330/COR, BuyLine 0058, pp. 1–24.
Sweet's General Building & Renovation 1996 Catalog File, Hearst Awning Company, Inc., "Accordion Shutters/Removable Shutters," B492, 08667/HUR, BuyLine 6400, pp. 1–8.
IMBAC, "Synoptical Tables, Rolling Shutters," two diagrams, one page.
Sweet's General Building & Renovation 1997 Catalog File, JF® DYNAFLAIR, "Security—With a Flair," 08330/DYL, BuyLine 5327, pp. 1–12.
LAKAL Rolladensysteme, "LAKAL Profil AHS 75," "LAKAL Rollgitter," "LAKAL Blendkappen 254 RS und 304 RS," "LAKAL Sicherheits–Führungsschiene," 4 pages.
Sweet'General Building & Renovation 1996 Catalog File, QMI Roll Shutter Supply, 08667/QMI, BuyLine 6925, 4 pages.
Sweet's General Building & Renovation 1997 Catalog File, R & S, "Rolling Door Products," 08330/RSM, BuyLine 7130, pp. 1–14.
Sweet's General Building & Renovation 1997 Catalog File, Raynor, "Rolling Doors & Electric Operators," 08330/RAY, BuyLine 3491, pp. 1–36.
ROLAX®, Wintergarten Rolläden, "Die Art Und Weise Sich Wohlzufühlen, " 4 pages.
Sweet's General Building & Renovation 1996 Catalog File, Roll–a–way, "Insulating Security Shutters," B500, 08667/ROM, BuyLine 1239, pp. 1–8.
Sweet's General Building & Renovation 1993 Catalog File, Rolladen®, Rolladen® Rollshutters, B499, 08667/ROL, BuyLine 6493, pp. 1–8.
Sweet's General Building & Renovation 1996 Catalog File, Rolladen®, Rolladen® Rollshutters, B499, 08667/ROL, BuyLine 6493, pp. 1–8, 1996.
SIRO, Safety Roller Blinds, "Safety roller blind Type Sd," "Safety roller blind Type Se 2 mm and Type Se 3 mm," "Safety roller blinds," 4 pages.
Sweet's General Building & Renovation 1993 Catalog File, Solaroll® Shade & Shutter Corporation, Catalog 561, B505, 08667/SOL/ BuyLine 1828, pp. 1–40.
Studio Star®, "The Special Slatter Roller Shutter for Every Shape of Window," Information from A to Z concerning the products of the Schanz Group, pp. 1–18.
Studio Star® Schanz, "SpezialRolläden, Für Alle Fenster–Formen," pp. 1–20.
Sweet's General Building & Renovation 1996 Catalog File, Willard Shutter Company, Inc., B515, 08668/WIL, BuyLine 1168, pp. 1–12.
Sweet's General Building & Renovation 1997 Catalog File, Windsor Door, "Metal Rolling Doors & Operators," 08330/WIN, BuyLine 7014, pp. 1–16.

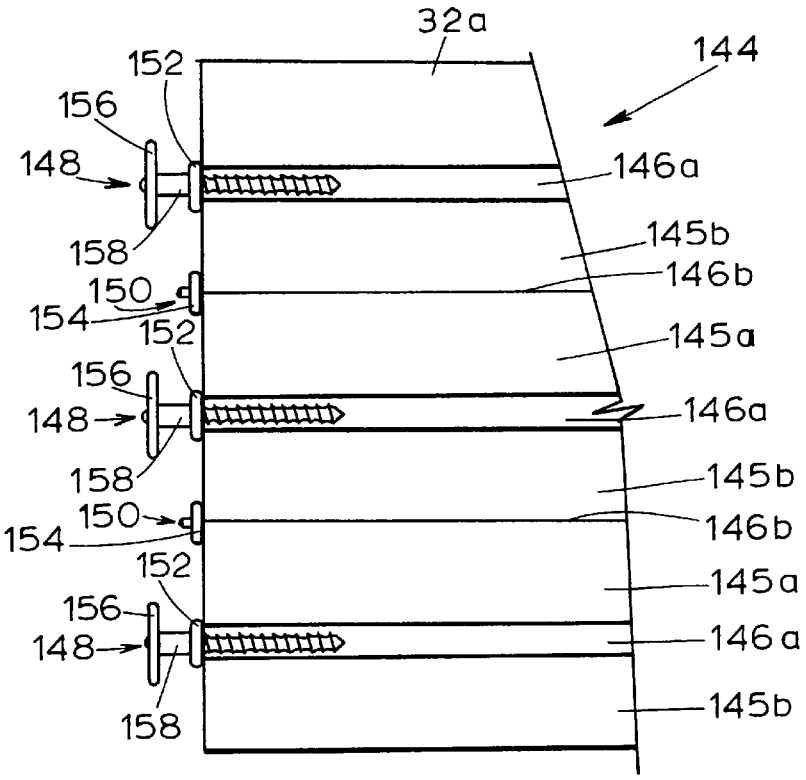
FIG. 9A
FIG. 9E
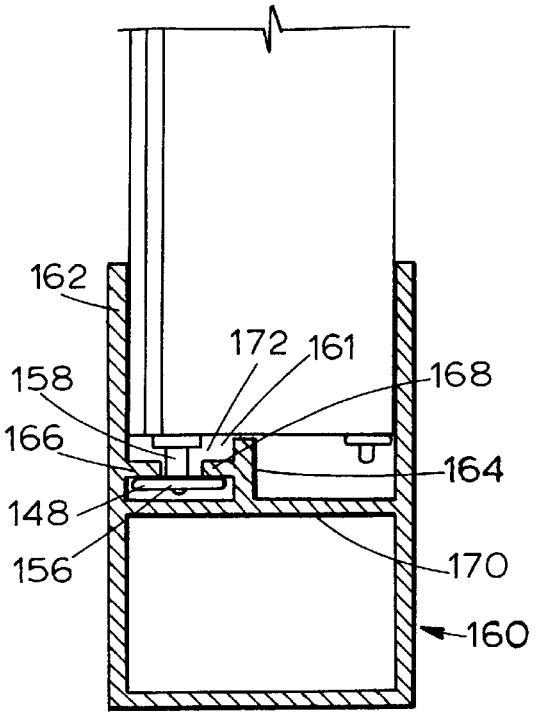
FIG. 9B
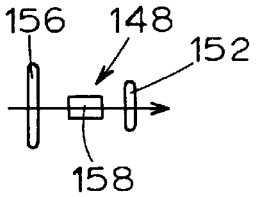
FIG. 9C
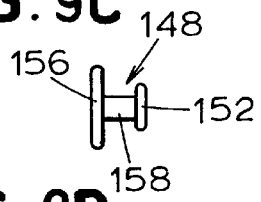
FIG. 9D
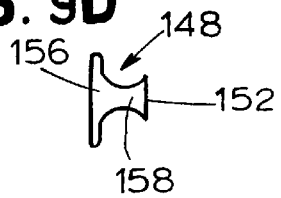

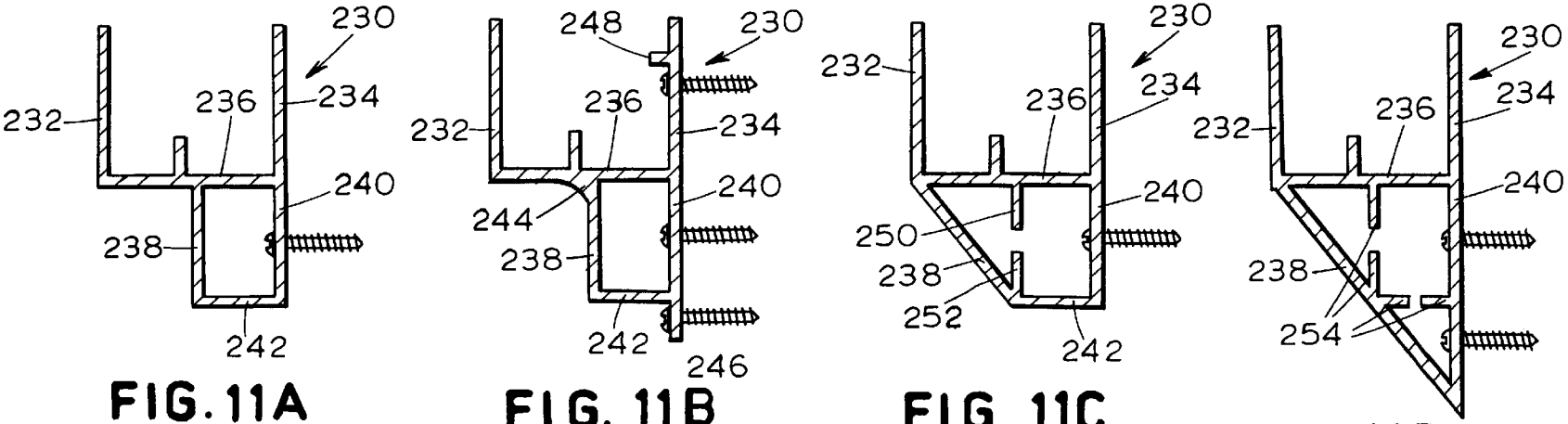
FIG. 11A
FIG. 11B
FIG. 11C
FIG. 11D
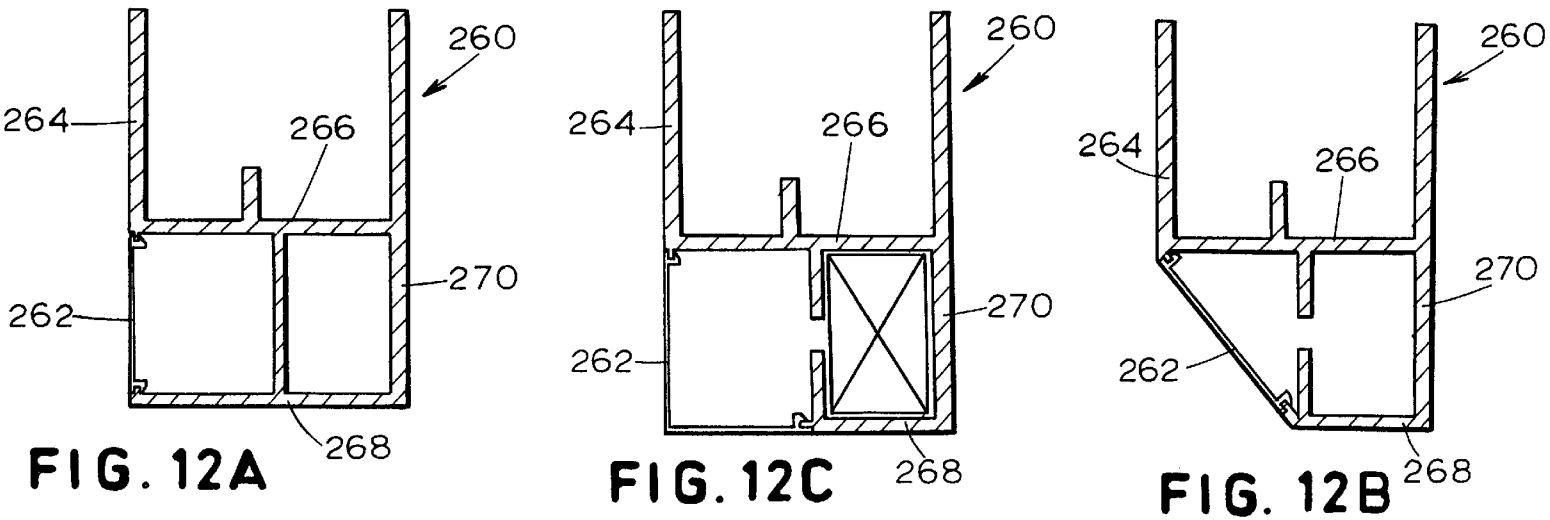
FIG. 12A
FIG. 12C
FIG. 12B

SIDE TRACKS ADAPTED FOR USE WITH ROLLING PROTECTIVE SHUTTERS

CROSS-REFERENCE TO RELATED APPLICATION

This application is a continuation-in-part of co-pending U.S. application Ser. No. 08/804,100, filed Feb. 20, 1997.

BACKGROUND OF THE INVENTION

The present invention is directed to a rolling protective shutter assembly which has a protective shutter, for covering a window or door opening, that may be rolled up into a shutter housing when not in use.

Rolling protective shutters are conventional and are used to provide protection against extreme weather conditions and to deter theft, for example. One such rolling protective shutter is disclosed in U.S. Pat. No. 5,575,322, issued to Miller on Nov. 19, 1996, entitled "Rolling Protective Shutters," which is hereby expressly incorporated by reference herein. As shown in FIGS. 1 and 2 of that patent, the Miller shutter is composed of a plurality of individual slats and a plurality of hinges interconnecting the slats. Each of the slats has a pair of end portions, and the slats include a first set of slats and a second set of slats, each of the slats in the first and second sets being alternated so that each of the hinges is connected to one of the slats in the first set and one of the slats in the second set. The shutter assembly has a pair of shutter tracks and means for rolling the shutter from an extended position in which the end portions of the slats are disposed in the shutter tracks to a retracted position in which the shutter is rolled up on a shutter support member. The hinges and the shutter tracks are adapted to facilitate, when the shutter is in the extended position, the slats in the first set of slats to occupy a first relative position and the slats in the second set of slats to occupy a second relative position.

In a conventional rolling shutter of the type in which the slats maintain a vertical position when the shutter is in its unrolled position, each side track for the rolling shutter forms a generally U-shaped channel for receiving the shutter slats, and includes a structural support member which forms a cavity running the entire length of the side track. The structural support member increases the strength of the side track in resisting forces applied to the shutter curtain, and provides a surface area for anchoring the side track against the frame of the opening covered by the shutter. The structural support member is also used to secure the shutter housing to the side track. As shown in FIG. 7, a prior art shutter housing 180 for a vertically-aligned slat shutter curtain 181 has an extension member 182, commonly referred to as an end cap nipple, extending therefrom on each end of the shutter housing 180. The shutter housing 180 is secured to a side track 184 by inserting the end cap nipple 182 into a cavity 186 created by a structural support member 188. The structural support member 188 frictionally engages the nipple 182 to prevent relative movement of the shutter housing 180 with respect to the side track 184.

In rolling shutter systems with vertically-aligned slats, the channel of the side tracks is dimensioned wide enough to accommodate the thickness of the shutter slats. These systems are typically divided into two types: mini systems, which use thinner slats, and maxi systems, which use slats that are thicker and stronger and require a slightly deeper side track. A standard-size nipple is used for both the mini and the maxi systems. The portion of the standard-size nipple extending from the shutter housing has a length a of approximately 2½", a width b of approximately ⅞" and a thickness c of approximately ⅝". FIGS. 8(*a*) and (*b*) illustrate side tracks 190, 194 having accommodation fins 192, 196, respectively, that enable the use of the standard-size nipple with both systems.

The rolling shutters having an angular configuration such as those disclosed in the Miller patent, require side tracks with a significantly wider channel to accommodate the angular configuration of the shutter slats. As a result, the width of the channel is significantly larger than the thickness of the standard-size end cap nipple. This necessitates significant modifications of the side tracks to adequately retain the nipple within the structural support member of the side track, and to ensure that the side track is strong enough to withstand forces applied to the shutter curtain due to vandalism and adverse weather conditions.

SUMMARY OF THE INVENTION

In one aspect, the invention is directed to a rolling shutter assembly having a pair of shutter tracks adapted to facilitate shutter slats occupying different relative orientations and including engagement means configured to frictionally engage a connection member, such as a standard-size end cap nipple. The rolling shutter assembly has a shutter support member, a shutter coupled to the shutter support member, and a pair of shutter tracks. The shutter is formed of a plurality of individual slats and a plurality of hinges interconnecting the slats. The shutter assembly has means for rolling the shutter from an extended position in which portions of the slats are disposed in the shutter tracks to a retracted position in which the shutter is rolled up on the shutter support member. The hinges and the shutter tracks are adapted to facilitate the slats to occupy different relative orientations when the shutter is in the extended position.

Each of the shutter tracks may be composed of a U-shaped channel having a front wall, a back wall, an end wall, a length and a channel width. Each of the shutter tracks may further include a support member connected to the end wall of the U-shaped channel and extend the length of the U-shaped channel. The end wall and the support member form a cavity that is adapted to receive a connection member. The engaging means is disposed within the cavity and is configured to frictionally engage the connection member.

In one embodiment, the support member may be composed of a front support wall and a back support wall connected to the end wall, and an end support wall connected between the front support wall and back support wall. The front support wall may be rigidly connected or, alternatively, demountably attached to the end wall and the end support wall. The engagement means may include a spacer wall connected between the end wall and the end support wall. Alternatively, the engagement means may include first and second spacer fins connected to the end wall and the end support wall, respectively. In another alternative, the engagement means may include a plurality of spacer fins connected to the front support wall.

In another aspect, the invention is directed to a rolling shutter assembly having a shutter support member and a shutter coupled to the shutter support member and comprising a plurality of shutter members including a slat and a hinge connected to the slat. The shutter members are grouped into a first set and a second set, with each of the shutter members of the first set having an end portion with and extension member extending outwardly. The shutter assembly has a pair of shutter tracks and means for rolling the shutter from the extended position in which the slat portions are disposed in the shutter tracks to a retracted position in which the shutter is rolled up on the shutter support member. The shutter assembly further includes a captivation means adapted to captivate the extension members in a direction substantially parallel the axes of rotation of the hinges.

In yet another aspect of the present invention, each of the hinges interconnects a first adjoining slat to a second adjoining slat. Each of the slats and hinges have an end portion with an extension member connected to one of the hinge, the first adjoining slat, and the second adjoining slat and extending outwardly from the end portion to which the extension member is connected. The extension members are adapted to engage the first and second adjoining slats to prevent lateral movement of the first adjoining slat relative to the second adjoining slat.

The features and advantages of the invention will be apparent to those of ordinary skill in the art in view of the detailed description of the preferred embodiments, which is made with reference to the drawings, a brief description of which is provided below.

BRIEF DESCRIPTION OF THE DRAWINGS

FIG. 9(*a*) is a front view of a portion of a rolling shutter curtain having rollers and pins according to the present invention;

FIGS. 9(*b*)–(*d*) are side views of alternative configurations for rollers according to the present invention;

FIG. 9(*e*) is a cross-sectional view of a portion of the rolling shutter curtain of FIG. 9(*a*) disposed within a side track;

FIG. 10(*e*) is an exploded side view of a rolling shutter assembly using the side track configuration of FIG. 10(*d*) with the end support wall removed;

FIG. 10(*f*) is a side view of a rolling shutter assembly using the side track configuration of FIG. 10(*d*) with the end support wall removed;

FIGS. 11(*a*)–(*d*) are cross-sectional views of side tracks for use with rolling shutter assemblies according to the present invention; and FIGS. 12(*a*)–(*c*) are cross-sectional views of side tracks with detachable front support walls for use with rolling shutter assemblies according to the present invention.

DETAILED DESCRIPTION OF THE PREFERRED EMBODIMENTS

Figure 1:
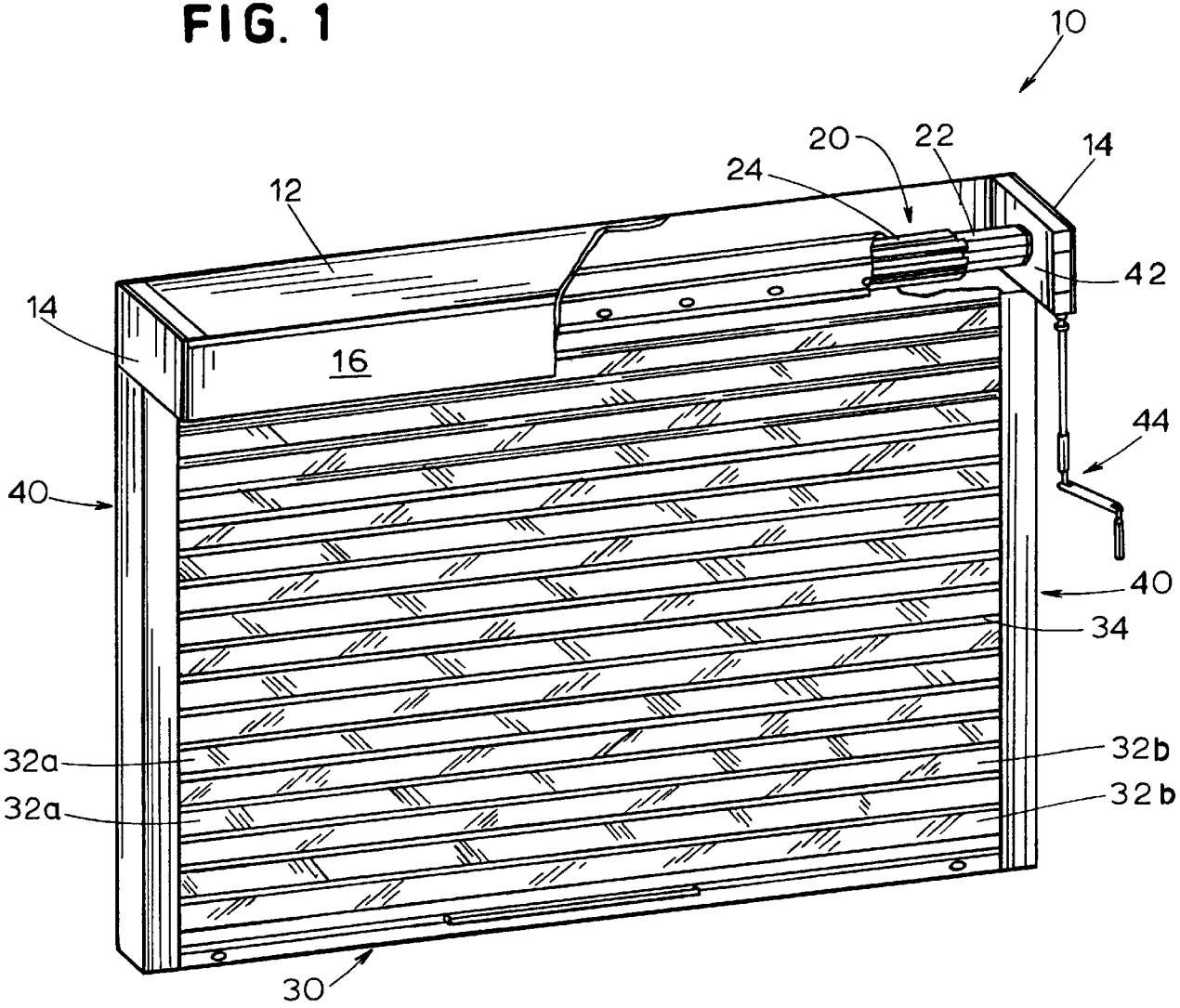
FIG. 1 is a perspective view of a first embodiment of a rolling shutter assembly in accordance with the invention.
Figure 2:
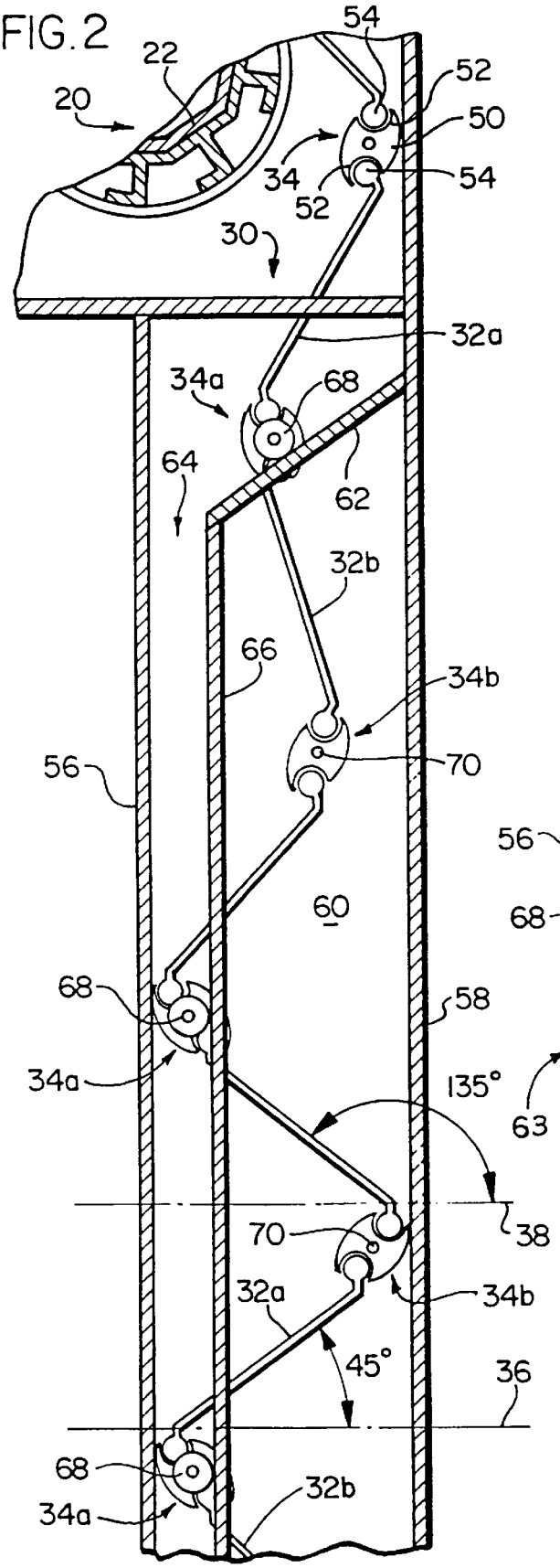
FIG. 2 is a cross-sectional side view of a portion of the shutter assembly of FIG. 1.

A first embodiment of a rolling shutter assembly 10 in accordance with the invention is shown in FIGS. 1–2. Referring to FIG. 1, the shutter assembly 10 has a shutter housing which includes a top wall 12, a pair of side walls 14, and a front wall 16. A shutter support member 20 is mounted for rotation within the shutter housing. The support member 20 includes a generally cylindrical central shaft 22 and a plurality of mounting members 24 fixed to the shaft 22.

The upper end of a rolling shutter 30 is coupled to the mounting members 24. The shutter 30 is composed of a plurality of individual, elongate slats 32. The slats 32, each of which is substantially flat, having two substantially planar side portions, and which may be composed of steel, are interconnected by a plurality of hinges 34, each of which joins together a pair of adjacent slats 32. The slats 32 include a first set of slats 32*a* and a second set of slats 32*b*, the first and second sets of slats being alternated, so that each hinge 34 is connected to one of the slats 32*a* in the first set and one of the slats 32*b* in the second set.

When the shutter 30 is in its unrolled position as shown in FIG. 2, the slats 32*a* in the first set occupy a first relative position in which they are aligned with a first angled direction, shown to be about 45° with respect to a horizontal axis 36, and the slats 32*b* in the second set occupy a second relative position in which they are aligned with a second angled direction, shown to be about 135° with respect to a horizontal axis 38. The angular position of the slats 32 could be varied so that the slats 32*a* in the first set occupy an angled direction between about 10° and about 80° with respect to the horizontal and so that the slats 32*b* in the second set occupy an angled direction between about 100° and about 170° with respect to the horizontal.

Referring back to FIG. 1, the ends of the slats 32 are disposed within a pair of shutter tracks 40. The shutter assembly 10 has a gearbox 42 which interconnects the rotatable shaft 22 with a handle 44 via a conventional gear assembly (not shown). When mounted to protect a window, the shutter tracks 40 of the shutter assembly 10 are positioned on either side of the window and the shutter housing is positioned over the top of the window. When the shutter 30 is not in use, it is rolled up on the shutter support member 20 via the handle 44 so that it is at least partially enclosed by the shutter housing. The handle 44 may be disposed on a rear portion of the shutter assembly 10 so that the shutter 30, when attached over a window for example, can be unrolled from inside the window.

Referring to FIG. 2, each of the hinges 34 is composed of an elongate member 50 having a pair of semi-circular sockets 52 formed therein and a pair of circular rods 54 pivotally disposed therein, each of the rods 54 being fixed to one of the slats 32 adjacent the hinge 34. Since the sockets 52 cover slightly over half the diameter of the rods 54, the rods 54 are permanently retained within the sockets 52. When the shutter 30 is in its unrolled position as shown in FIG. 2, each of the hinges 34 makes contact with one side of the shutter tracks 40.

The hinges 34 are grouped into a first set of hinges 34*a* and a second set of hinges 34*b* alternated with the first set of hinges 34*a*. The first set of hinges 34*a* include first extension members, such as rollers 68, which extend outwardly from the end of the hinge 34*a*. The second set of hinges 34*b* may include second extension members, such as pins 70, which extend outwardly from the end of the hinge 34*b*.

Figure 3:
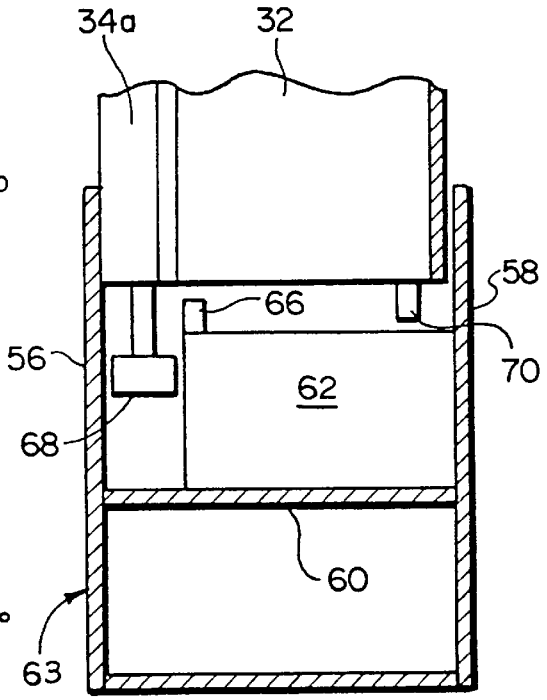
FIG. 3 is a cross-sectional top view of a portion of the shutter assembly of FIG. 1.

The structure of the shutter tracks 40 is illustrated in FIGS. 2 and 3. Each shutter track 40 is composed of a pair of side walls 56, 58 joined by an end wall 60. An angled plate 62 is attached proximate the end wall 60 and directs the roller 68 on hinge 34*a* into a guide channel 64 as the shutter 30 is unrolled from the shutter support member 20. The guide channel 64 is formed by the side wall 56 and a guide wall 66. As shown in FIG. 3, a structural support member 63 may be disposed on the outside of the end wall 60 to provide additional structural support to the shutter track 40.

Referring to FIG. 2, the plate 62 and guide wall 66 act to shape the shutter 30 as it is unrolled from the shutter support member 20 to an extended position. As the shutter 30 is unrolled, the rollers 68 on the hinges of the first set 34*a* come into contact with the plate 62 which directs the hinges 34*a* toward the guide channel 64. Once in the guide channel 64, the guide wall 66 retains the rollers 68 within the guide channel 64. As illustrated in FIG. 3, the pin 70 is short enough so that the pin 70 does not contact the plate 62, and long enough so that the pin 70 will contact the guide wall 66, thus preventing the hinges 34*b* from entering the guide channel 64. Consequently, as the shutter 30 is unrolled, the hinges 34*a* are disposed on one side of the guide wall 66 and the hinges 34*b* are disposed on the other side of the guide wall 66, thus forming the desired V-shape, as shown in FIG. 2.

Extension members, such as rollers 68 and pins 70 disclosed herein and in subsequent examples, are attached to the hinges 34 for illustrative purposes. It is within the province of one skilled in the art to attach rollers, pins, bushings or other extension members to the slats 32 to achieve the same results.

The extension members can also function to keep the slats horizontally aligned from one slat to the next and to captivate the slats within the side tracks to prevent the shutter from pulling out of the tracks during a break in or extreme wind conditions. FIGS. 9(*a*)–(*g*) illustrate alternative extension members which perform one or both of these functions.

Referring to FIG. 9(*a*), an alternative embodiment of a shutter 144 has slats 145*a* of a first set alternated with slats 145*b* of a second set. Rollers 148 extend outwardly from the ends of hinges 146*a* of a first set and pins 150 extend outwardly from the ends of hinges 146*b* of a second set. Each of the rollers 148 and pins 150 has an inner portion 152, 154, respectively, which engages both slats 145 joined by the corresponding hinge 146 to prevent relative lateral movement of the slats 145, thereby keeping all the slats 145 of the shutter 144 aligned. The rollers 148 further include outer portions 156 separated from the inner portions 152 by neck portions 158. The outer portions 156 of the rollers 148 are captivated within a guide channel in a manner described more fully below. The inner portion 152, outer portion 156 and neck portion 158 can be fabricated as individual components (FIG. 9(*b*)) or integrally formed as a single piece (FIG. 9(*c*), (*d*)), and mounted on the shutter 144 by an appropriate fastener such as a screw or hinged connector. Other fasteners are contemplated by the applicant and will be apparent to those of ordinary skill in the art.

FIG. 9(*e*) illustrates a side track 160 configured to captivate the rollers 148 when the slats 145 are deployed and the rollers 148 are within a guide channel 161. A side wall 162 and a guide wall 164 include keeper fins 166, 168, respectively, extending into the guide channel 161 for the length of the guide wall 164. The keeper fins 166, 168 are positioned to allow the outer portions 156 of the rollers 148 to enter the space between the keeper fins 166, 168 and an end wall 170 of the side track 160, and provide an opening 172 that is larger than an outer diameter of the neck portion 158 and smaller than an outer diameter of the outer portion 156. When the slats 145 of the deployed shutter 144 begin to bow due to an attempted break-in or extreme wind conditions, the outer portions 156 of the rollers 148 bear upon the keeper fins 166, 168, thereby preventing the ends of the slats 145 from being pulled out of the side track 160.

Figure 4:
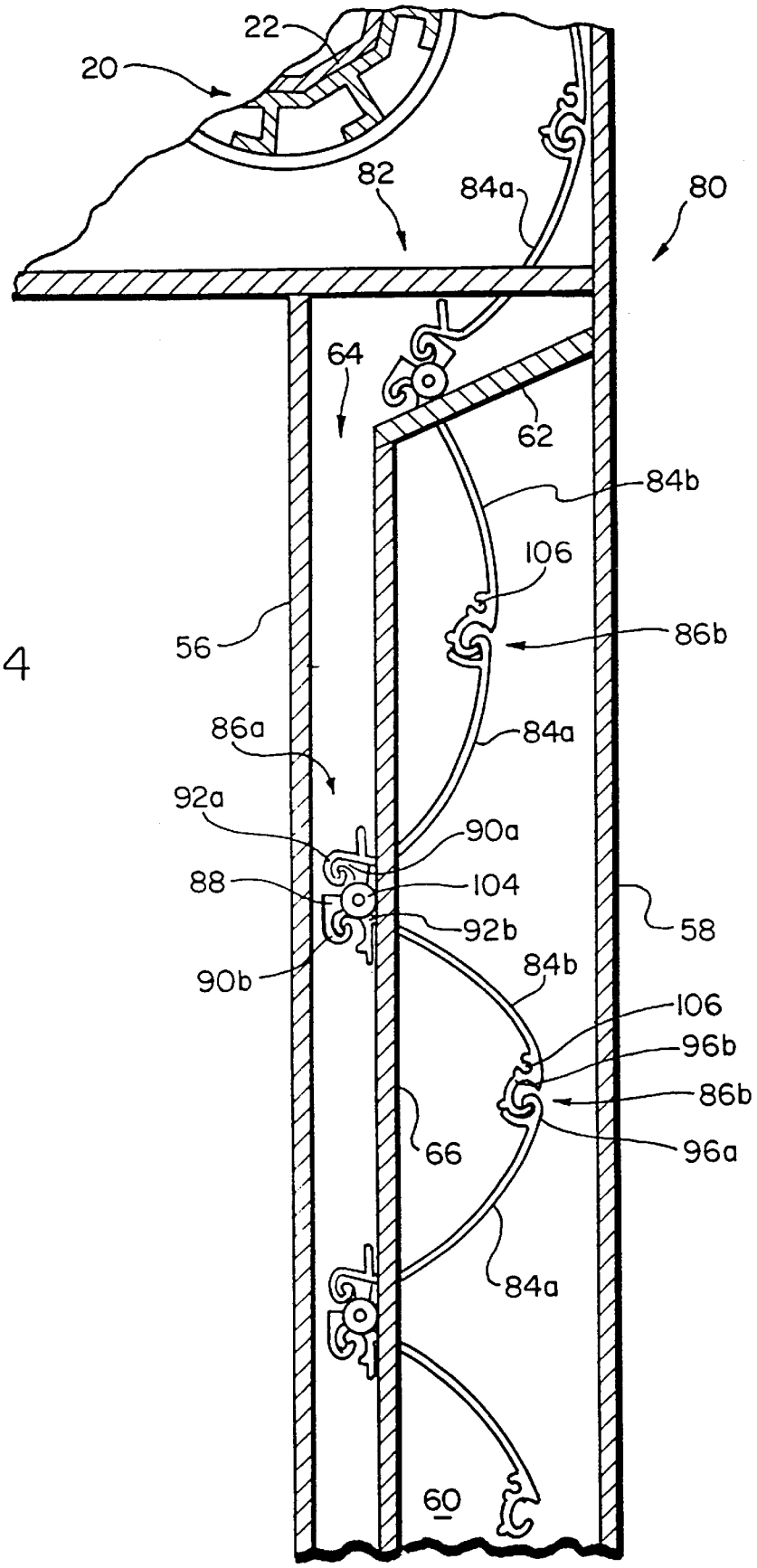
FIG. 4 is a cross-sectional side view of a portion of a second embodiment of a shutter assembly in accordance with the invention.
Figures 5, 6:
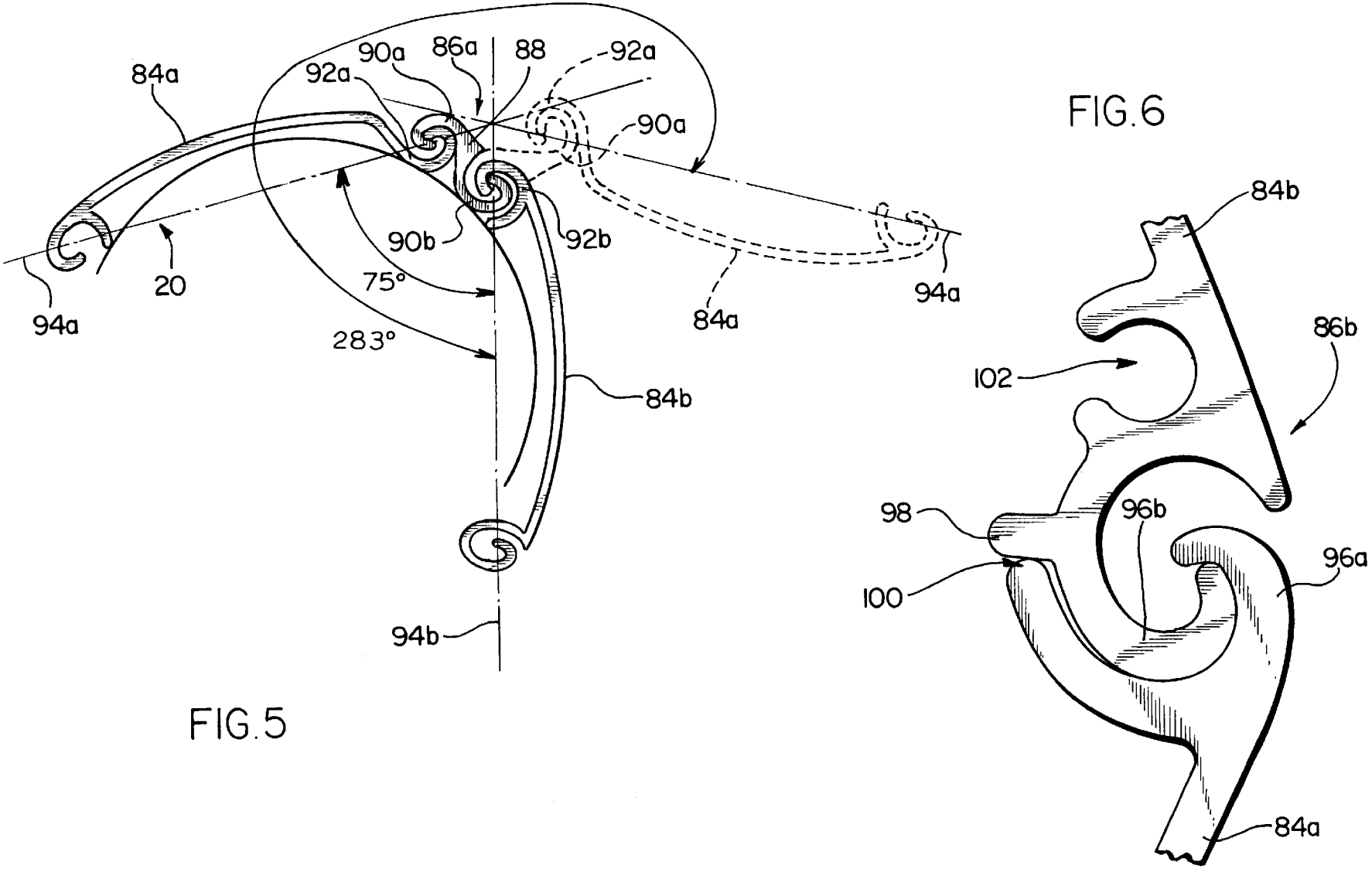
FIG. 5 is a side view of a pair of individual shutter slats pivotally interconnected via an alternative hinge.
FIG. 6 is a side view of a pair of individual shutter slats pivotally interconnected via another alternative hinge.
Figure 7:
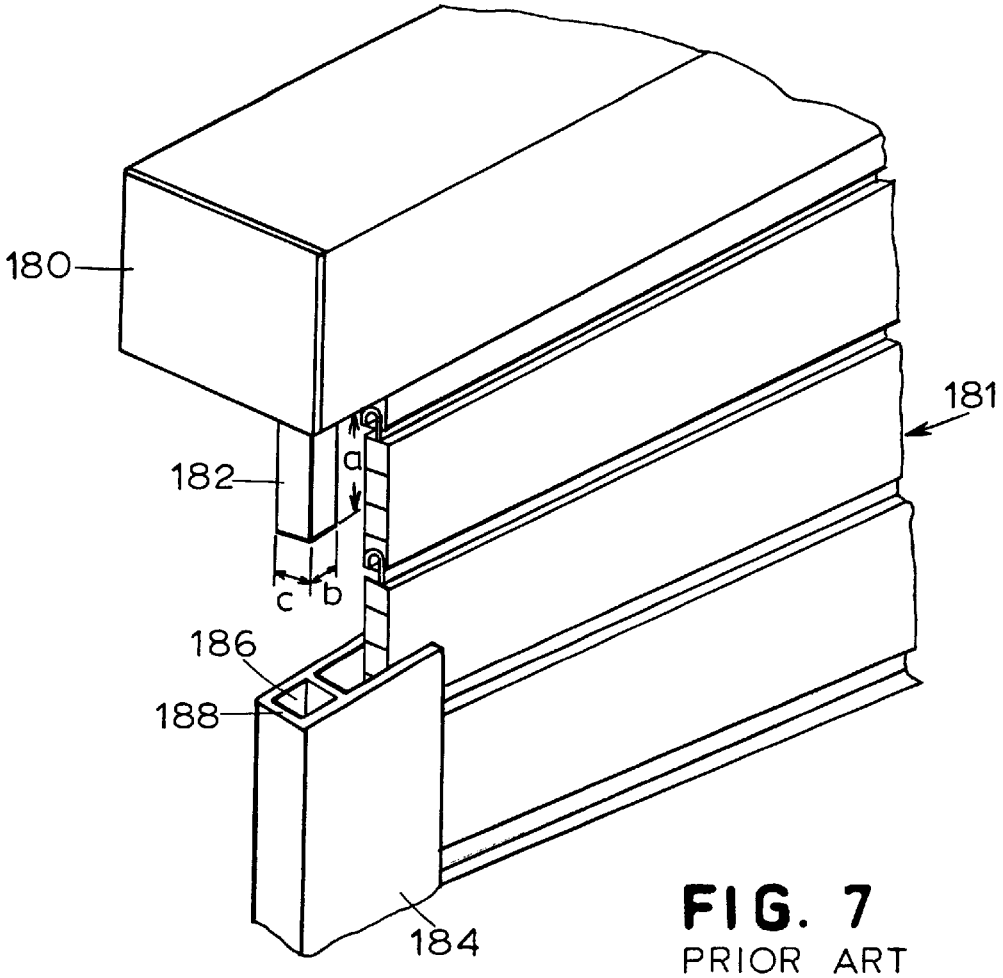
FIG. 7 PRIOR ART
FIG. 7 is a partially exploded isometric view of a rolling shutter assembly having vertically-aligned slats.
Figure 8A:
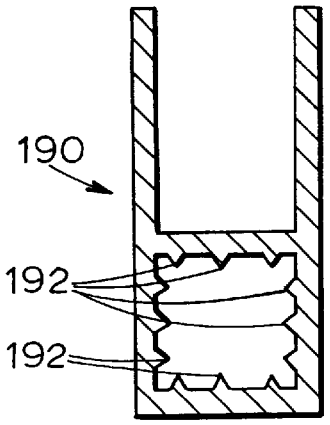
FIGS. 8(*a*)–(*b*) are cross-sectional views of side tracks for use with the rolling shutter assembly of FIG. 7.
Figure 8B:
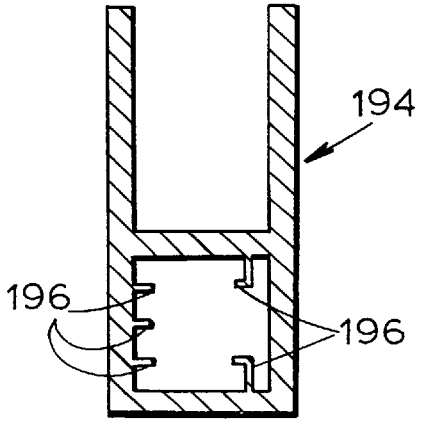
Figure 10D:
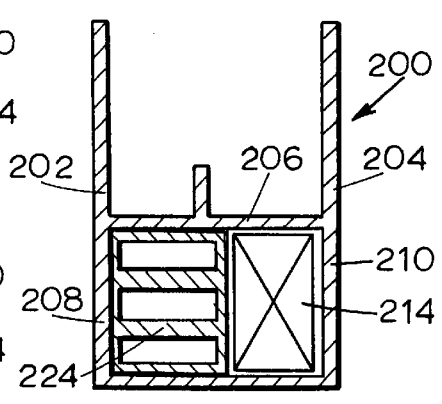
FIGS. 10(*a*)–(*d*) and (*g*) are cross-sectional views of side tracks for use with rolling shutter assemblies according to the present invention.
Figure 10C:
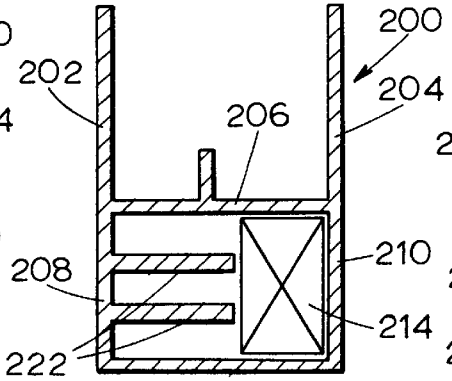
Figure 10B:
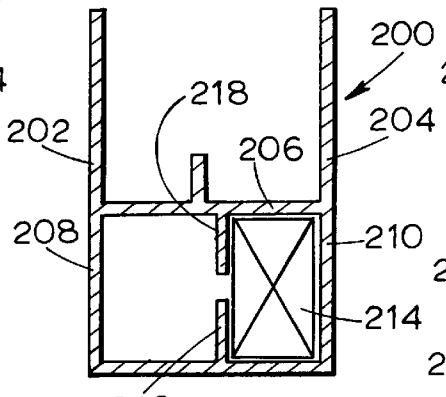
Figure 10A:
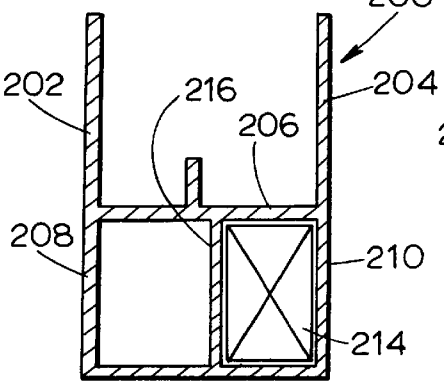
Figure 10F:
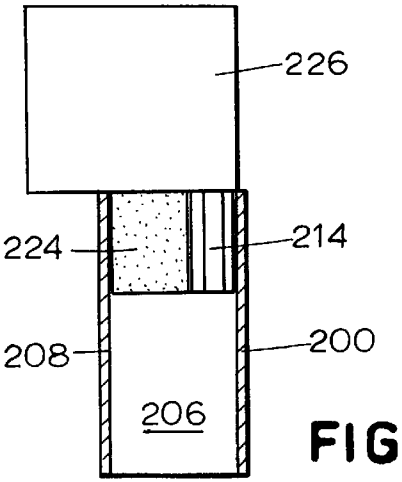
Figure 10E:
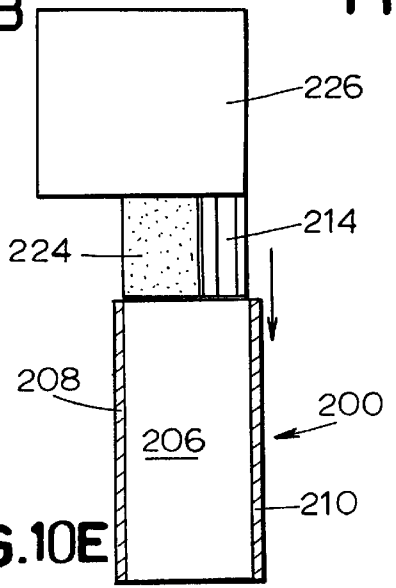
Figure 10G:
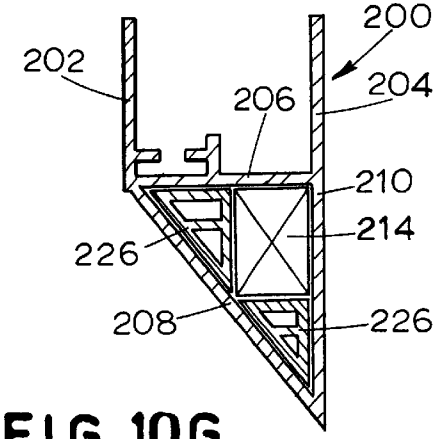

A portion of a second embodiment of a shutter assembly 80 is shown in FIGS. 4–6. The shutter assembly 80 has the same components of the shutter assembly 10 of FIG. 1, except that the structure of the shutter 82 is different. The shutter assembly 80 has a shutter 82 which has a first set of slats 84*a* and a second set of slats 84*b* alternated with the first set of slats 84*a*. The shutter assembly 80 also has a shutter 82 which has a first set of spiral hinges 86*a* and a second set of spiral hinges 86*b* alternated with the first set of spiral hinges 86*a*.

An example of a spiral hinge of the first set 86*a* is illustrated in FIG. 5. Each hinge 86*a* is composed of a link 88 having a first pair of spiral sections 90*a*, 90*b* formed therein, and a second pair of spiral sections 92*a*, 92*b* fixed to slats 84*a*, 84*b*, respectively. Spiral section 90*a* interlocks spiral section 92*a* and spiral section 90*b* interlocks spiral section 92*b* in a manner that allows the rotation of slats 84*a*, 84*b* relative to link 88. Hinge 86*a* permits a broad range of motion for slat 84*a* relative to slat 84*b*. This range includes acute angles when shutter 80 is rolled up on shutter support member 20, shown to be about 75° between a center line 94*a* on slat 84*a* and a center line 94*b* on slat 84*b*, and extreme angles when shutter 80 is in the extended position, shown to be about 283° between center lines 94*a*, 94*b*. Persons of skill in the art will be able to adapted hinge 86*a* to allow for a range of motion in excess of 330°.

Referring to FIG. 6, an example of a hinge of the second set 84*b* is illustrated. Hinge 84*b* is composed of a pair of spiral sections 96*a*, 96*b* fixed to slats 84*a*, 84*b*, respectively. Spiral section 96*a* interlocks spiral section 96*b* in a manner that allows the rotation of slat 84*a* relative to slat 84*b*. Spiral section 96*b* may be provided with a rigid member, such as extrusion 98, which extends from spiral section 96*b* and engages a tip 100 of spiral section 96*a* at a point in the rotation, thus preventing further rotation in hinge 86*b*. Extrusion 98 is essentially a cantilever beam extending from spiral section 96*b*, but those skilled in the art will identify other methods for stopping the rotation of hinge 86*b* at a fixed point. Spiral section 96*b* may also be provided with an opening, such as boss 102, for attachment of an extension member, such as a roller or pin as described above.

Referring back to FIG. 4, the plate 62 and guide channel 66 act to shape the shutter 82 as it is unrolled from the shutter support member 20 to its extended position. As the shutter 82 is unrolled, rollers 104 on the hinges of the first set 86*a* come into contact with the plate 62 which directs the hinge 86*a* toward the guide channel 64. Once in the guide channel 64, the guide wall 66 retains the roller 104 within the guide channel 64. Pins 106 extend far enough from the hinges 86*b* to contact the guide wall 66 while avoiding the plate 62, thus preventing the hinges 86*b* from entering the guide channel 64. Consequently, as the shutter 82 is unrolled, the hinges 86*a* are disposed on one side of the guide wall 66 and the hinges 86*b* are disposed on the other side of the guide wall 66, thus forming the desired V-shape.

FIGS. 10(*a*)–(*f*) illustrate alternative configurations wherein a side track 200 is configured to retentively engage a standard-size end cap nipple. Referring to FIG. 10(*a*), the side track 200 includes a front wall 202, a back wall 204, and an end wall 206 to form the U-shaped channel into which the shutter slats are deployed. The side track 200 further includes a front support wall 208, back support wall 210, and an end support wall 212 which collectively form the structural support member for mounting the side track 200 to the frame of the opening and to secure a rolling shutter housing to the side track 200 by the insertion of a standard-size end cap nipple 214 therein. The distance between the front wall 202 and the back wall 204 and, consequently, the front support wall 208 and the back support wall 210 is significantly greater than the thickness of the nipple 214. Therefore, the side track 200 further includes a retention wall 216 running between the end wall 206 and the end support wall 212. The retention wall 216 is spaced a distance from the back support wall 210 such that the retention wall 216 and back support wall 210 frictionally engage the nipple 214 when it is inserted therebetween.

In FIG. 10(*b*), an alternative configuration of the side track 200 replaces the retention wall 216 with a first spacer fin 218 extending from the end wall 206 and a second spacer fin 220 extending from the end support wall 212. As with the retention wall 216, the first spacer fin 218 and second spacer fin 220 are spaced a distance from the back support wall 210 such that the standard nipple 214 is frictionally engaged by the spacer fins 218, 220 and the back support wall 210. In yet another alternative, FIG. 10(*c*) shows a side track 200 wherein a plurality of spacer fins 222 extend from the front support wall 208 toward the back support wall 210. The spacer fins 222 extend far enough such that the ends of the spacer fins 222 and the back support wall 210 frictionally engage the standard-size nipple 214 when inserted therebetween.

FIGS. 10(*d*)–(*f*) illustrate yet another alternative configuration of the side track 200 wherein a separate spacer member 224 is provided which is inserted concurrently with the standard nipple 214 into the cavity formed by the side wall 206, front support wall 208, back support wall 210, and side support wall 212. Referring to FIG. 10(*e*), which shows a partial sectional view of the side track 200 with the end support wall 212 removed, the spacer member 224 is approximately the same length as the standard-size nipple 214 extending from a rolling shutter housing 226. The combined thickness of the spacer member 224 and the nipple 214 is approximately equal to or slightly less than the distance between the front support wall 208 and the back support wall 210. In this way, the spacer member 224 and nipple 214 are concurrently inserted into the cavity and the spacer member 224 prevents movement of the nipple 214 toward the front support wall 208, as shown in FIG. 10(*f*).

FIGS. 11(*a*)–(*d*) illustrate additional alternative configurations for a side track 230 which provides varying levels of strength and cost of materials in fabrication. Referring to FIG. 11(*a*), the side track 230 includes a front wall 232, a back wall 234, and an end wall 236 that form the U-shaped channel for receiving the rolling shutter slats. The side track 230 further includes a front support wall 238, a back support wall 240, and an end support wall 242 which provide structural support for mounting the side track 230 to the frame of the covered opening and form a cavity for insertion of a standard-size end cap nipple (not shown) therein. In this configuration, the front support wall 238 is spaced from the back support wall 240 by a distance that will allow insertion and frictional engagement of the standard-size nipple therebetween. This configuration of the side track 230 eliminates the need for the separate spacing accommodations illustrated in FIGS. 10(*a*)–(*f*) and minimizes the amount of material required to form the side track 230.

Referring to FIG. 11(*b*), a slightly stronger configuration of the side track 230 is shown. The side track 230 has the same general configuration as illustrated in FIG. 11(*a*) with an additional radius of material 244 at the intersection of the end wall 236 and the front support wall 238. The radius of material 244 increases the strength of the intersection to resist the force of negative pressure suction on the shutter curtain which tends to force the front wall 232 away from the back wall 234. The side track 230 further includes an external tab 246 which extends the back support wall 240 beyond the end support wall 242, thereby providing an attachment point for additional fasteners. Within the channel of side track 230, a nub 248 extends inwardly from back wall 234 toward the front wall 232. The nub 248 provides clearance between the back wall 234 and the shutter slats, thereby allowing for the further provision of additional fasteners within the channel of the side track 230 without interfering with the deployment of the shutter slats.

Yet another alternative configuration for side track 230 is illustrated in FIG. 11(*c*). In this configuration, the end support wall 242 extends from the back support wall 240 for a distance slightly greater than the thickness of a standard-size end cap nipple. The front support wall 238 extends at an angle from the intersection of the front wall 232 and the end wall 236 to the end support wall 242. This configuration further increases the strength of the side track 230 over the configuration illustrated in FIG. 11(*b*). The side track 230 further includes a first spacer fin 250 extending from the end wall 236 and a second spacer fin 252 extending from the intersection of the front support wall 238 and the end support wall 242 to retentively engage the standard-size nipple in the same manner as illustrated and discussed with respect to FIG. 10(*b*). Alternatively, the side track 230 of FIG. 11(*c*) can include any of the standard-size end cap nipple accommodations illustrated in FIGS. 10(*a*)–(*d*). FIG. 11(*d*) illustrates another configuration of the side track 230 in which the front support wall 238 extends at an angle from the intersection of the front wall 232 and the end wall 236 until it intersects the back support wall 240, thereby forming a triangular configuration between the end wall 236, the front support wall 238 and the back support wall 240. This configuration eliminates the end support wall 242. A plurality of spacer fins 254 retentively engage the standard-size nipple along with the end wall 236 and the back support wall 240.

In several of the side track embodiments discussed above, the front support wall is spaced away from the back support wall by an amount that is significantly greater than the length of the fasteners used to anchor the side track to the frame of the covered opening. In previous rolling shutter systems, the side tracks are narrow enough that an installer is not likely to drop a fastener into the cavity between the front support wall and the back support wall. In these systems, a large hole is provided on the front wall of the side track and a smaller hole provided on the back wall. The head of the fastener passes through the front wall and fastens the back wall to the frame. After the side track is mounted, plugs are inserted into the large holes to finish the surface of the front wall.

Conversely, in side tracks for use with rolling shutters according to the present invention, the distance between the front support wall and the back support wall can be greater than the length of the fasteners used to mount the side tracks to the frame of the enclosed opening. An installer will encounter great difficulty in attempting to insert tools and fasteners through holes in the front support wall and faces a high likelihood that one or more fasteners will fall between the front support wall and the back support wall. FIGS. 12(*a*)–(*c*) illustrate alternative configurations of a side track 260 in which a front support wall 262 is demountably attached between the intersection of a front wall 264 and an end wall 266, and an end support wall 268. During installation, the front support wall 262 is detached from the side track 260 to allow access to the cavity formed by the end wall 266, the front support wall 262, the end support wall 268 and a back support wall 270. With the front support wall 262 detached, the installer has easy access to the back support wall 270 to fasten the side track 260 to the frame of the covered opening. Once the side track 260 is mounted to the frame, the front support wall 262 is snapped into place and provides additional structural support for the side track 260.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A rolling shutter assembly, comprising:

a shutter support member;

a shutter housing enclosing said shutter support member, said housing having a pair of connection members having a connection member thickness and extending from opposite ends of said shutter housing;

a shutter coupled to said shutter support member, said shutter comprising a plurality of individual slats and a plurality of hinges Interconnecting said slats, each of said slats having a pair of slat portions and a slat thickness;

a pair of shutter tracks, each of said shutter tracks having a U-shaped channel having an external surface and a channel width substantially greater than said slat thickness and said connection member thickness;

a support member connected to said external surface of said U-shaped channel thereby forming a cavity between said U-shaped channel and said support member, said cavity adapted to receive one of said connection members;

a spacer member configured for contemporaneous insertion into the cavity with said connection member, said spacer member frictionally engaging said support member and said connection member; and a rolling mechanism adapted to roll said shutter from an extended position in which said slats are disposed in said shutter tracks to a retracted position in which said shutter is rolled up on said shutter support member;

said hinges and said shutter tracks being adapted to facilitate said slats to occupy different relative orientations when said shutter is in said extended position.

2. A rolling shutter assembly according to claim 1, wherein said cavity is triangular.

3. A rolling shutter assembly, comprising:

a shutter support member;

a shutter housing enclosing said shutter support member, said housing having a pair of connection members having a connection member thickness and extending from opposite ends of said shutter housing;

a shutter coupled to said shutter support member, said shutter comprising a plurality of individual slats and a plurality of hinges interconnecting said slats, each of said slats having a pair of slat portions and a slat thickness;

a pair of shutter tracks, each of said shutter tracks comprising:

a U-shaped channel having an external surface and a channel width substantially greater than said slat thickness and said connection member thickness;

a support member connected to said external surface of said U-shaped channel, wherein said external surface and said support member define a triangular cavity adapted to receive one of said connection members; and a spacer member configured for contemporaneous insertion into said cavity with said connection member;

a rolling mechanism adapted to roll said shutter from an extended position in which said slats are disposed in said shutter tracks to a retracted position in which said shutter is rolled up on said shutter support member;

said hinges and said shutter tracks being adapted to facilitate said slats to occupy different relative orientations when said shutter is in said extended position.

* * * * *